United States Patent [19]

Nishimiya

[11] 4,258,918

[45] Mar. 31, 1981

[54] MAZE GAME HAVING SINGLE CONTROL

[75] Inventor: Toru Nishimiya, Tokyo, Japan

[73] Assignee: Tomy Kogyo Co., Inc., Tokyo, Japan

[21] Appl. No.: 96,698

[22] Filed: Nov. 23, 1979

[30] Foreign Application Priority Data

Feb. 10, 1979 [JP] Japan ..... 54-16158

[51] Int. Cl.[3] ..... A63F 7/00; A63F 7/38

[52] U.S. Cl. ..... 273/110

[58] Field of Search ..... 273/110, 113, 117, 115, 273/116; 74/569

[56] References Cited

U.S. PATENT DOCUMENTS

| | | | |
|---|---|---|---|
| 2,008,588 | 7/1935 | Moodie | 273/110 |
| 3,188,087 | 6/1965 | Larson | 273/110 |
| 3,239,226 | 3/1966 | Matte | 273/110 |
| 3,706,455 | 12/1972 | Meyer | 273/110 |
| 3,787,055 | 1/1974 | Kraemer | 273/110 |
| 3,811,676 | 5/1974 | Greenberg | 273/110 |
| 4,034,985 | 7/1977 | Breslow et al. | 273/110 |
| 4,055,341 | 10/1977 | Martinez | 273/86 C |
| 4,089,526 | 5/1978 | Olving | 273/110 |

FOREIGN PATENT DOCUMENTS

| | | | |
|---|---|---|---|
| 365064 | 3/1921 | Fed. Rep. of Germany | 273/110 |
| 767766 | 7/1934 | France | 273/110 |
| 1056493 | 2/1954 | France | 273/110 |

*Primary Examiner*—Richard C. Pinkham
*Assistant Examiner*—Scott L. Brown
*Attorney, Agent, or Firm*—K. H. Boswell; Edward D. O'Brian

[57] ABSTRACT

A game in which a player attempts to move an object through a maze has a housing which has an upstanding fulcrum located within the housing. A platform member having a maze located on its upper surface which is viewable outside of the housing is located in the housing above the fulcrum such that the platform member rests on the fulcrum and is tiltable a full 360 degrees about the fulcrum. A portion of the platform serves as a cam follower. A cam member is rotatably mounted on the housing adjacent to the fulcrum and positioned so as to be capable of interacting with that portion of the platform serving as a cam follower. In response to rotation of the cam the platform, including the maze located thereon, is tilted. An object located within the maze is capable of moving within the maze in response to tilting of platform.

10 Claims, 6 Drawing Figures

10
68
62
34
24
48
40
30
34
66
32
32
46
60
60
12
58
20
44
38
42

68
34
30
32
24
62
48
40
10
34
66
46
60
60
12
20
44
58
38
42

68
62
10
48
40
66
24
30
60
58
46
60
12
20
44
38
42

MAZE GAME HAVING SINGLE CONTROL

BACKGROUND OF THE INVENTION

This invention pertains to a game having a maze located on a tiltable platform. The platform is tilted in response to rotation of a cam member which interacts with the platform. An object located within the maze can be moved within the maze as the platform tilts.

U.S. Pat. No. 3,811,676 describes a game having a maze and an object. The maze is supported by a plurality of springs around the underside of its perimeter and the object is manipulated through the maze by foot pressure on various areas of the game. A second maze-type game is disclosed in U.S. Pat. No. 4,034,985 wherein a maze is located on the surface of a platform and on the underneath surface of the same platform there is a pointed fulcrum. Projecting outwardly from the sides of the platform are several handles. The platform is tilted by manipulating the handles in order to cause an object to roll through the maze. U.S. Pat. No. 3,706,455 describes a maze game which, like the game immediately above, has a platform with a fulcrum located on the bottom side. This game, however, does not include any handles or the like, but instead includes a plurality of tiles which can be rearranged on the platform to form a variety of patterns within the maze. U.S. Pat. No. 4,055,341 also describes a maze game utilizing a platform, except in this game several platforms are used by several players in competition. The platforms in this game are designed to be stood upon and tilted by shifting of the weight of a person playing the game.

U.S. Pat. No. 3,787,055 describes a variation of the above games. In this patent the platform is not manipulated directly by hand or feet, but instead is under the control of two handles. This gives this game a degree of sophistication over and above the previously mentioned games in that the player must learn to coordinate the movement of the platform in response to the handles. As can be seen from all of the above maze games, the utilization of a maze in a game provides an interesting game.

It is considered, however, that there exists a need for further maze games wherein the maze is under the control of a single lever or member and thus require a different kind of coordination between player and game in order for the player to tilt the maze in order to move the object.

BRIEF SUMMARY OF THE INVENTION

It is an object of this invention to provide a maze game wherein the maze is controlled by movement of a single lever. It is a further object to provide a game incorporating this principle which is simple in construction and operation and thus durable in use and easily manufactured. With easy manufacture, it is a further object to provide an economically priced game.

These and other objects are achieved by providing a game which comprises a housing having an upstanding fulcrum means located on the housing; a platform means having a maze located on a surface of the platform which is viewable outside the housing, said platform means positioned in said housing above said fulcrum means so as to rest on said fulcrum means and be tiltable 360 degrees about said fulcrum means, said platform means including a cam follower means located near one edge of said platform; a cam means rotatably mounted on said housing adjacent to said fulcrum means and positioned to be capable of interacting with said cam follower means such that said platform means including said maze is tilted in response to rotation of said cam means; an object located within said maze and capable of moving within said maze in response to tilting of said platform means.

In the preferred embodiment the platform means comprises an essentially planar platform rectangular in shape having a biasing means along one of its edges. The biasing means biases that edge in a downward direction. The underside of that edge serves as a cam follower means. The cam means comprises a rotatable disk having an upstanding cam on a portion of its surface. The disk fits beneath the downward biased edge and the cam alternately lifts or allows that edge to descend as the disk is rotated.

BRIEF DESCRIPTION OF THE DRAWINGS

This invention will be better understood when taken in conjunction with the drawing wherein.

Figure 1:
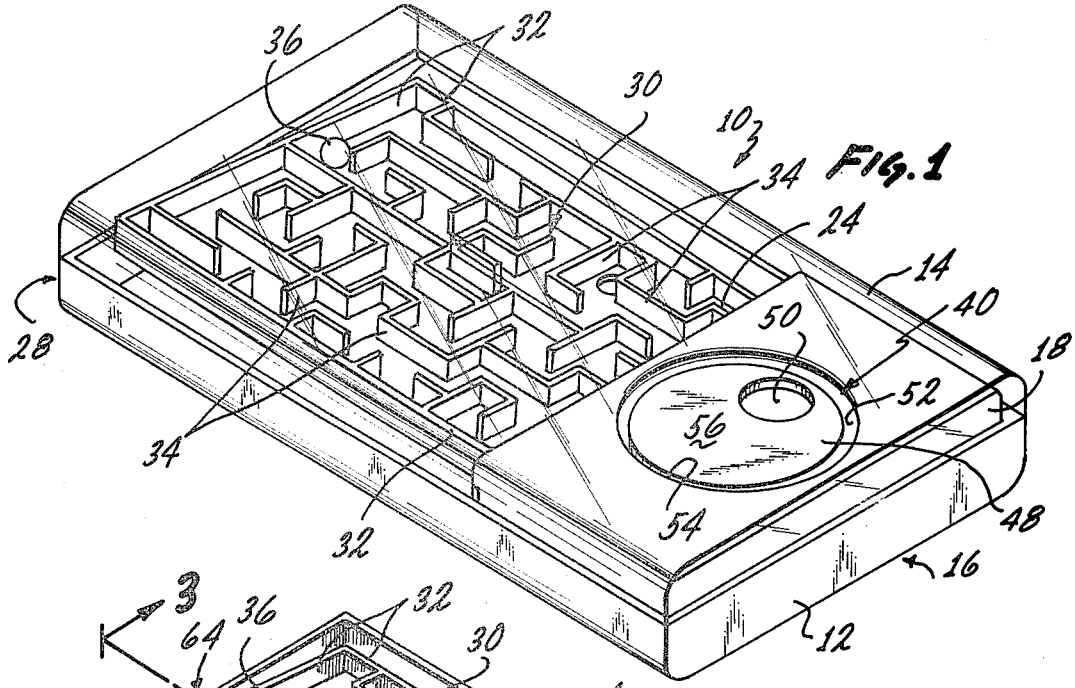
FIG. 1 is an isometric view of the maze game of this invention.
Figure 2:
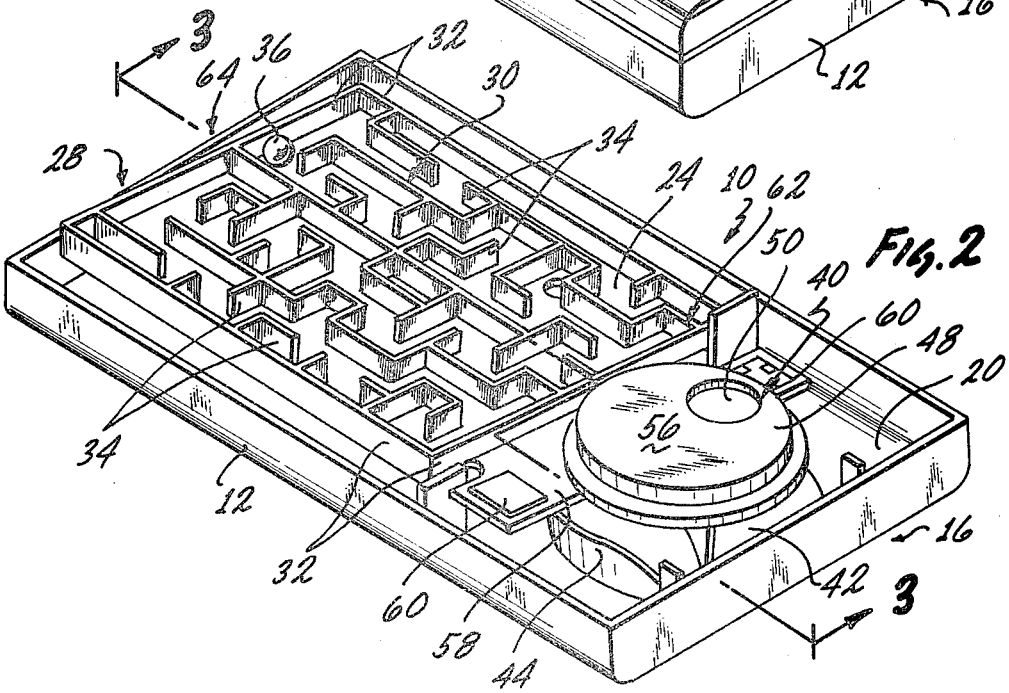
FIG. 2 is an isometric view similar to FIG. 1 with certain overlying housing components removed to show the components underneath.
Figure 3:
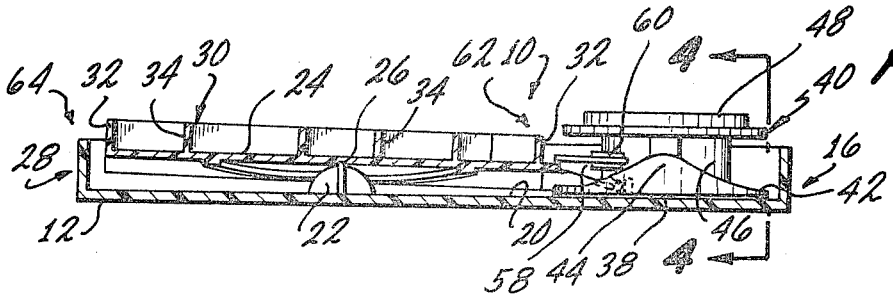
FIG. 3 is a side elevational view in partial section about the line 3—3 FIG. 2.

The invention described in this specification and shown in the drawings utilizes certain principles and/or concepts as are set forth and claimed in the appended claims. Those skilled in the toy arts to which this invention pertains will realize that these principles and/or concepts could be utilized in a number of differently appearing embodiments different from the exact embodiment described herein. For this reason, this invention is to be construed in light of the appended claims and is not to be construed as being limited to the exact embodiment herein described.

DETAILED DESCRIPTION

The maze game 10 has a lower housing 12 and an upper housing 14. The upper housing 14 is prepared from a transparent material allowing viewing through it to components located below it. Located just below the upper housing 14 at end 16 of the game 10 is an internal housing 18. The internal housing 18 covers certain working components as hereinafter described and prevents viewing of the working mechanism of the game to the player playing the game.

Located on the lower surface 20 of lower housing 12 and projecting upwardly is a fulcrum member 22. Positioned over the fulcrum member is a platform 24. The fulcrum member 22 is placed in the center of the lower housing 12 with respect to the longitudinal axis (i.e., from end 16 to end 28) of the housing. Platform 24 has a small circular indent 26 in its lower surface which rests on the fulcrum member 22 thus suspending the platform 24 on the fulcrum member 22. The platform 24 is free to pivot in all directions about the fulcrum member 22. Positioned on the top of the platform 24 is a maze 30. The maze 30 has four upstanding outer walls collectively identified by the numeral 32 and a plurality of inner walls collectively identified by the numeral 34. The inner walls 34 are all placed at right angles to one another and have breaks between them forming the tortuous maze 30.

Since the platform 24 is free to pivot about the fulcrum member 22 the maze 30 can be tilted a full 360 degrees. An object 36, preferredly spherical, is located within the maze 30 and as the maze 30 pivots or tilts the object will pass through the breaks between the inner walls 34. It is the object of the game to successfully move the object 36 from a starting point somewhere within the maze to a finishing point elsewhere in the maze 30.

Projecting upwardly from the lower surface 20 of lower housing 12 near end 16 is an upstanding boss 38. A cam member 40 is located about the boss 38 by a centralized hole (not shown or numbered) in the bottom of cam member 40. The cam member 40 consists of a disk 42 which lies parallel to the lower surface 20 of the lower housing 12, a curved cam 44 projecting vertically upward from the disk 42 and a central pillar member 46. The cam 44 goes around a portion of the periphery of the disk 42 comprising about 120 degrees of the disk 42. The cam 44 slowly curves upward in a smooth curve to a curved peak and then descends in an identical smooth curve.

Keyed to pillar member 46 is a manipulation disk 48. Manipulation disk 48 contains an off-center hole 50 which is sized to receive the end of one of the player's digits. The manipulation disk 48 and its hole 50 are exposed through a centralized opening 52 in interior housing 18. An identically sized hole 54 in upper housing 14 allows the upper surface 56 of manipulation disk 48 and hole 50 to be exposed through the upper housing 14. Since manipulation disk 48 is keyed to pillar member 46 which in turn is attached to disk 42, turning manipulation disk 48 turns disk 42.

Figure 4:
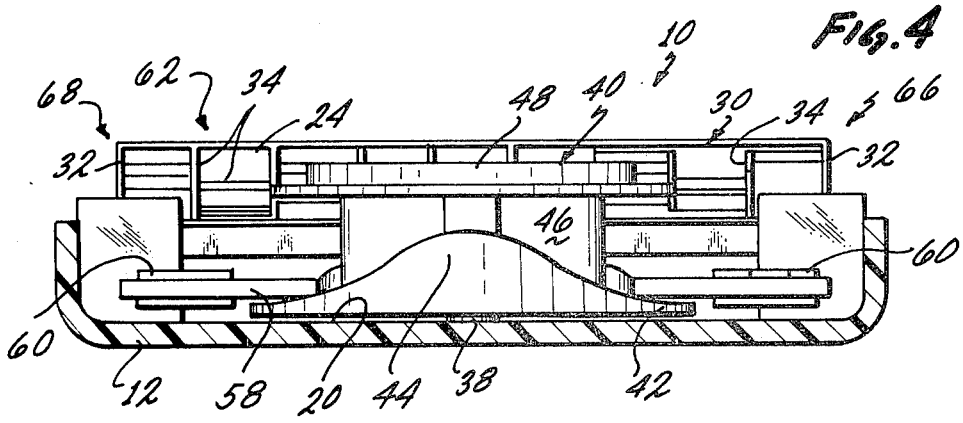
FIG. 4 is an end elevational view about the line 4—4 of FIG. 3.

Platform 24 is essentially rectangular in shape. A portion 58 of this platform 24 extends beyond the periphery of maze 30 toward end 16 of game 10. Located at the corners of both sides of this portion 58 are two small weights collectively identified by the numeral 60. These weights 60 bias portion 58 of platform 24 downwardly toward the lower surface 20 of lower housing 12. Disk 42 fits underneath portion 58 of platform 24. The portion 58 of platform 24 is notched to fit around pillar member 46 and the underside of portion 58 of platform 24 serves as a cam follower for cam 44. When, as shown in FIG. 4, the cam 44 is rotated such that it is located closest to end 16, side 62 of platform 24 can descend under the bias of weights 60 tilting the maze 30 in a direction wherein side 62 of platform 24 is depressed while side 64 of platform 24 is elevated and both sides 66 and 68 of platform 24 are inclined.

Figure 5:
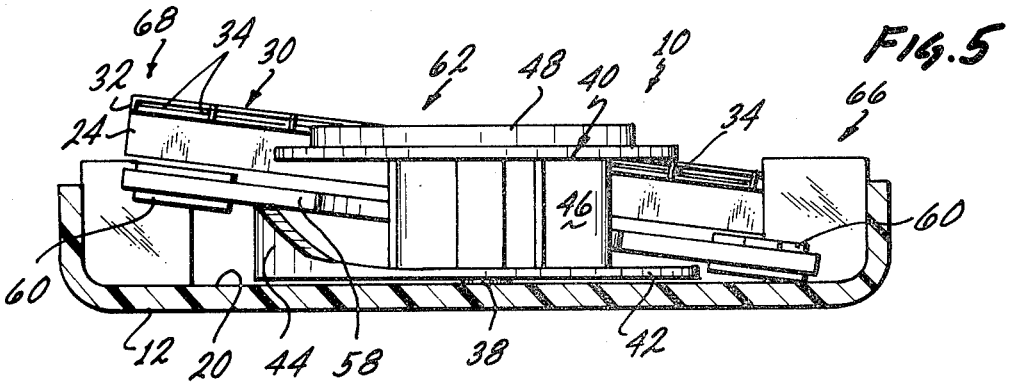
FIG. 5 is an end elevational view similar to FIG. 4 except showing certain components in a different spatial relationship.
Figure 6:
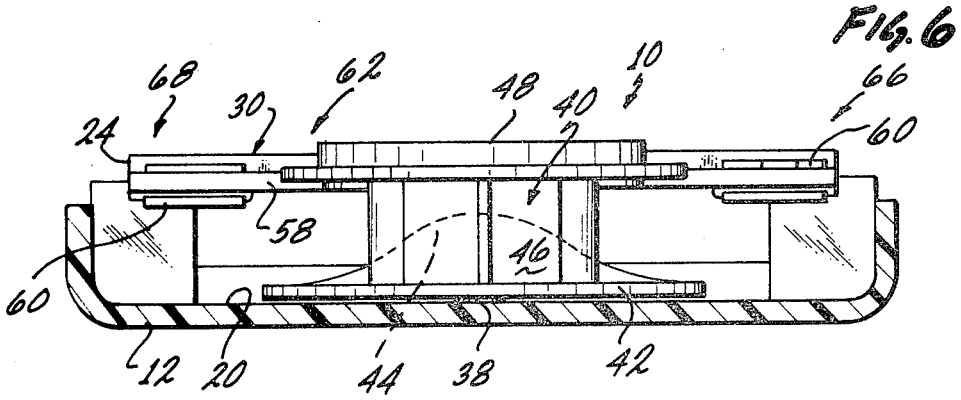
FIG. 6 is an end elevational view similar to FIGS. 4 and 5 except showing certain components in a different spatial relationship.

When the disk 42 is rotated about 90 degrees clockwise by rotation of the manipulation disk 48, the peak of the cam 44 comes to rest underneath portion 58 of platform 24 closest to side 68. This raises side 68 upwardly and causes side 66 to descend while sides 62 and 64 are inclined as is shown in FIG. 5. Rotation of the disk 42 an additional 90 degrees clockwise as is shown in FIG. 6 places the cam 44 directly below portion 58 of platform 24. This elevates side 62, depresses side 64 and inclines sides 66 and 68 oppositely to that shown in FIG. 4. A further 90 degrees clockwise rotation places the cam 44 underneath portion 58 of platform 24 closest to side 66. This elevates side 66, depresses side 68 and inclines sides 62 and 64 opposite of how they are shown in FIG. 5.

Each of the individual weights 60 help to depress the appropriate side of the platform 24 to which they are attached. Thus, side 68 is depressed by one of the weights while side 66 is depressed by the other of the weights, and side 62 is depressed by both of the weights. Side 64 is not under the influence of the weights as far as being depressed by them, but is depressed as a consequence of when the cam 44 lifts side 62.

Since the manipulation disk 48 freely and reversibly rotates in a circle either clockwise or counterclockwise, platform 24 and the maze 30 are tilted first to one side, then to the side right or left of the first side. From here it can be returned to the first side or to the opposite side from the first side. It is thus possible to tilt maze 30 360 degrees around the fulcrum member 22 enabling the player to manipulate the object 36 through the maze.

The use of the cam as a single control for tilting the maze introduces an interesting aspect in the game which is not found in games having a first control for tilting along the longitudinal axis of a maze and a second control for tilting along the transverse axis of the maze. In the game of this invention if a player has, for example, side 62 depressed and he wants to switch to a situation wherein side 64 is depressed, he must go through a sequence wherein either side 66 or 68 is depressed before he can depress side 64. He must thus make an instant decision which is the best pathway. This decision making adds additional interest to the game of this invention.

I claim:

1. A maze game which comprises:

a housing having an upstanding fulcrum means located on said housing;

a platform means having a maze located on a viewable surface of said platform means, said platform means positioned in said housing above said fulcrum means so as to rest on said fulcrum means and be tiltable 360 degrees about said fulcrum means, said platform means including a cam follower means located near one edge of said platform;

a single cam rotatably mounted on said housing and positioned to be capable of interacting with said cam follower means such that said platform means including said maze is able to be tilted 360 degrees in response to rotation of said single cam means;

an object located within said maze and capable of moving within said maze in response to tilting of said platform means.

2. The game of claim 1 including:

said edge of said platform means wherein said cam follower means is located also including a biasing means such that said edge of said platform containing said biasing means and said cam follower means is biased downwardly.

3. The game of claim 2 wherein:

said platform means comprises an essentially planar platform having an upper surface and a lower surface, said maze located on at least a portion of said upper surface, at least that portion of said platform wherein said maze is located being positioned in said housing so as to expose said maze to view of said player using said game;

said cam follower means comprises a portion of said lower surface of said platform.

4. The game of claim 3 wherein:

said platform is essentially rectangular in shape;

said biasing means comprises a weight means, said weight means located on said platform and biasing said portion of said platform wherein said weight means is located downwardly under the influence of gravity.

5. The game of claim 4 wherein:

said weight means comprises two weights, one of said weights located at one end of one of the shorter sides of said rectangular platform, the other of said weights located at the other end of said shorter side of said rectangular platform, said underneath surface of said platform between said weights interacting with said single cam.

6. The game of claim 5 wherein:

said single cam comprises a rotatably mounted disk having an upstanding cam projecting upwardly along a portion of the perimeter of said disk, said disk located in said housing such that in one position said portion of the perimeter of said disk wherein said cam is located is positioned underneath said side of said platform wherein said weights are located lifting said side of said platform wherein said weights are located against the bias of said weights and in a second position wherein said disk is rotated 180 degrees from said first position said cam is located distal from said side of said platform wherein said weights are located allowing said side of said platform wherein said weights are located to descend against the surface of said disk.

7. The game of claim 6 including:

rotation means operatively attaching to said disk and exposed outside of said housing so as to be capable of being rotated by a digit of a player of said game.

8. The game of claim 7 wherein:

said maze comprises said platform having four upstanding walls located at right angles to each other forming a quadrilateral housing, a plurality of upstanding walls located within said quadrilateral housing at right angles to each other and to the walls of said quadrilateral housing forming a tortuous pathway on the upper surface of said platform.

9. The game of claim 8 wherein:

said fulcrum means comprises an upstanding member located in said housing and having its uppermost surface tapering to a rounded point;

said lower surface of said platform including a concave indent located in said lower surface so as to fit over said rounded point of said fulcrum means when said platform is placed on said fulcrum means.

10. The game of claim 9 wherein:

said cam extends around in an arc subtending about 120 degrees of said disk curving upwardly from the surface of said disk to a peak and then curving back to the surface of said disk such that said peak is located midway in said arc.

* * * * *